US005660306A

United States Patent [19]

Kim

[11] Patent Number: 5,660,306

[45] Date of Patent: Aug. 26, 1997

[54] CLOSURE, DISPENSING ASSEMBLY AND METHOD FOR USING THE CLOSURE

[76] Inventor: Il Yoo Kim, 7945 Audubon Ave. No. A-6, Alexandria, Va. 22306

[21] Appl. No.: 540,017

[22] Filed: Oct. 6, 1995

[51] Int. Cl.[6] ..... B67D 5/00

[52] U.S. Cl. ..... 222/83; 222/536; 222/542; 222/568

[58] Field of Search ..... 222/81, 83, 85, 222/89, 91, 185.1, 192, 529, 530, 542, 568, 179, 536, 520; 239/146, 150, 151, 379, 532, DIG. 14; 285/162, 196, 338

[56] References Cited

U.S. PATENT DOCUMENTS

| | | | |
|---|---|---|---|
| 25,765 | 4/1859 | Ankney . | |
| 464,019 | 12/1891 | Hall . | |
| 631,008 | 8/1899 | Goodamote . | |
| 1,401,584 | 12/1921 | Cizek . | |
| 2,307,691 | 1/1943 | Vasseur . | |
| 3,198,437 | 8/1965 | Faglie . | |
| 3,650,440 | 3/1972 | Gorniak | 222/565 |
| 3,667,658 | 6/1972 | Young | 222/569 |
| 4,852,775 | 8/1989 | Zordan | 222/569 |
| 5,020,690 | 6/1991 | Kishikawa et al. | 222/83 |
| 5,131,553 | 7/1992 | Geasland | 220/235 |

*Primary Examiner*—Andres Kashnikow
*Assistant Examiner*—Philippe Derakshani
*Attorney, Agent, or Firm*—Aquilino & Welsh

[57] ABSTRACT

A selectively attachable closure for a container. The closure includes a valve member connected to a restraining member by structure for causing the restraining member to be drawn toward the valve member. The closure further includes a central expandable member positioned between the valve member and the restraining member. The central expandable member is caused to outwardly expand when the restraining member is drawn toward the valve member. The central expandable member includes a hollow body positioned about the restraining member so that the central expandable member is supported by the restraining member. In use, the restraining member and the central expandable member are passed within a hole formed in a container while the valve member is seated on a periphery of the hole to support the closure, and the restraining member is drawn toward the valve member causing the central expandable member to outwardly expand and secure the closure within the hole.

22 Claims, 2 Drawing Sheets

CLOSURE, DISPENSING ASSEMBLY AND METHOD FOR USING THE CLOSURE

BACKGROUND OF THE INVENTION

1. Field of the Invention

The invention relates to closures for dispensing devices. More particularly, the invention relates to a closure for a paint can, or other container filled with a liquid material, that is secured to a wall on the can to permit convenient dispensing of the materials contained therein. The invention also relates to a method for using the closure to permit, application of the liquid to a predetermined object, as well as an assembly for performing the method.

2. Description of the Prior Art

Many liquids are stored in containers having wide dispensing openings. For example, paints, stains, sealants and other materials are normally stored in containers having a wide dispensing opening at one end of the container. The openings of these containers are covered by large caps which cover the entire opening. Before the liquid material can be removed from the container, the cover must be removed, and the liquid is then dispensed directly from the container or by pouring the liquid into another container from which the material can be applied to a predetermined object. For example, when an individual removes the cover of a paint can, the individual must either use the paint directly from the paint can or pour the paint into another container for use. Either way, the paint, or other liquid, is exposed to the environment in a manner permitting the paint to be spilled, contaminated, or otherwise effected in an undesirable manner.

Devices have recently become available for applying liquids, specifically paints and stains, without continuously dipping a brush or roller into a container full of paint. Generally, these devices rely upon a pressure source to force the liquid through an applicator (for example, a spray gun, brush or roller). The pressure may either be applied automatically or manually. In either case the liquid must be transferred from the container to another container specially designed for use with the applicator or the liquid can be used directly from an opened container.

Other applicators rely upon gravity to supply the force needed to drive the liquid through the applicator and onto the desired object. For example, U.S. Pat. No. 3,650,440, to Gorniak, discloses an "Applicator for Flooring Materials". The applicator includes a tank into which liquid flooring materials are poured. The liquid materials are subsequently dispensed through a dispensing device as shown in FIG. 1 of the patent. As with the devices previously discussed that require a pressure source for the application of liquid, the device disclosed by Gorniak requires that the applied liquid to be transferred to a tank specially designed for use with the applicator.

After studying the prior art devices, it is apparent that a need continues to exist for a convenient, reliable and inexpensive apparatus and method for dispensing liquids from a closed container. The present invention provides such an apparatus, method, and assembly for use.

SUMMARY OF THE INVENTION

It is, therefore, an object of the present invention to provide a selectively attachable closure for a container. The closure includes a valve member connected to a restraining member by means for causing the restraining member to be drawn toward the valve member. The closure further includes a central expandable member positioned between the valve member and the restraining member. The central expandable member is caused to outwardly expand when the restraining member is drawn toward the valve member. The central expandable member includes a hollow body positioned about the restraining member so that the central expandable member is supported by the restraining member. In use, the restraining member and the central expandable member are passed within a hole formed in a container while the valve member is seated on a periphery of the hole to support the closure. The restraining member is then drawn toward the valve member causing the central expandable member to outwardly expand and secure the closure within the hole.

It is also an object of the present invention to provide a method for dispensing liquids from a container without exposing the liquids to the environment before they are actually dispensed for use. The method is performed by cutting an opening within the wall of a sealed container and positioning a closure within the opening of the container to seal the opening. The container is then elevated, and liquid is permitted to flow from the container and through the closure to an applicator for applying the liquid to a predetermined object.

It is further an object of the present invention to provide an assembly for dispensing liquids from a sealed container without exposing the liquids to the environment until the liquids are applied to a predetermined object. The assembly includes a selectively attachable closure for attachment to an opening formed in the sealed container, a stand for supporting the container at an elevated position, and an applicator adapted for attachment to the valve member of the closure to permit a flow of the liquid from the container to the applicator permitting application of the liquid to a predetermined object.

Other objects and advantages of the present invention will become apparent from the following detailed description when viewed in conjunction with the accompanying drawings, which set forth certain embodiments of the invention.

DESCRIPTION OF THE PREFERRED EMBODIMENTS

The detailed embodiment of the present invention is disclosed herein. It should be understood, however, that the disclosed embodiment is merely exemplary of the invention, which may be embodied in various forms. Therefore, the details disclosed herein are not to be interpreted as limited, but merely as the basis for the claims and as a basis for teaching one skilled in the art how to make and/or use the invention.

Figure 1:
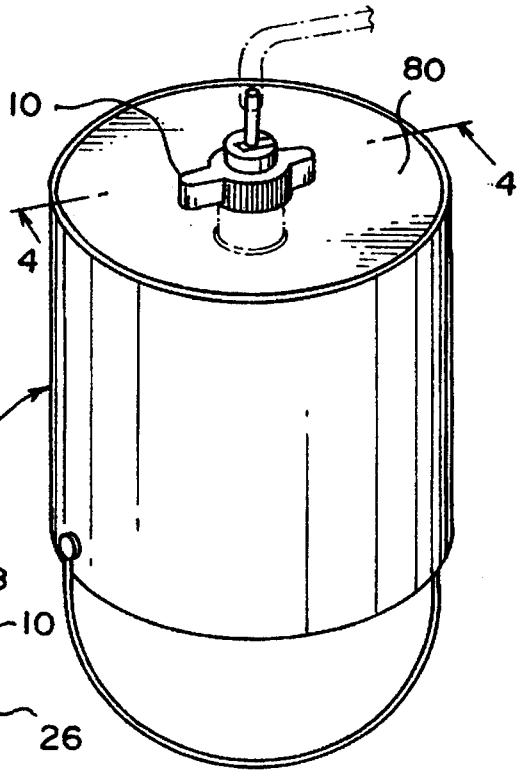
FIG. 1 is a perspective view of the closure attached to a paint can.
Figure 2:
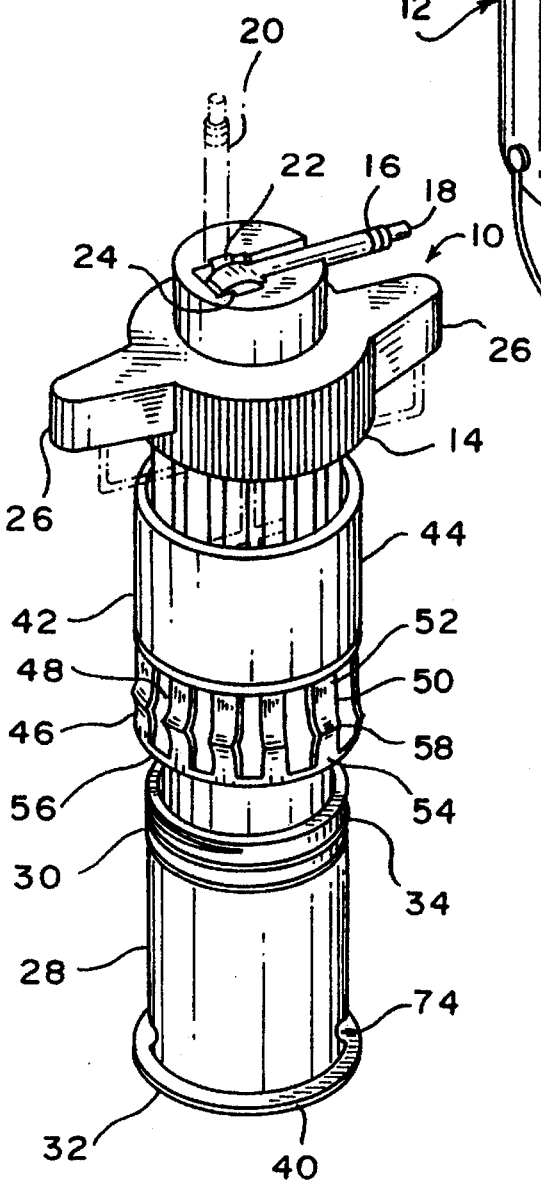
FIG. 2 is an exploded view of the present closure.

With reference to FIG. 1, a closure 10 in accordance with the present invention is shown secured to the bottom of a typical paint can 12. It should be understood, that while the closure 10 was designed with paint cans in mind it could be used with containers for a variety of materials without departing from the spirit of the present invention. With reference to FIG. 2, the selectively attachable closure 10 for a container is disclosed in greater detail. The closure 10 includes a valve member 14 having a spout 16 pivotally mounted thereon. The spout 16 pivots between a first closed position 18 in which liquid is not able to pass through the spout and a second opened position 20 in which liquid may pass through the spout 16. The spout 16 is pivotally secured to the valve member 14 via pivot pins 22 seated in openings 24 in the body of the valve member 14. Other structures for securing the spout to the valve member could be utilized without departing from the spirit of the present invention.

The valve member 14 also includes a pair of outwardly extending handles 26 formed integrally with the main body of the valve member 14. The handles 26 permit the valve member 14 to be gripped and rotated in a manner that will be discussed in greater detail below.

The valve member 14 is selectively connected to a cylindrical restraining member 28. The valve member 14 and the restraining member are connected by threading which permits the valve member 14 and the restraining member 28 to be drawn toward each other. Specifically, the restraining member 28 includes a proximal end 30 and a distal end 32. The proximal end 30 includes outwardly directed threading 34 dimensioned to engage internal threading 36 on the inner surface 38 of the valve member 14. The distal end 32 of the restraining member 28 includes a ledge 40 positioned about the circumference of the distal end 32 of the restraining member 28. The ledge 40 supports a central expandable member 42 in a manner that will be discussed in greater detail.

The central expandable member 42 is positioned between the valve member 14 and the restraining member 28, whereby the central expandable member 42 is caused to outwardly expand when the restraining member 28 is drawn toward the valve member 14. Specifically, the expandable member 42 is cylindrical and is shaped to have a diameter slightly larger than the restraining member 28, but slightly smaller than the internal diameter of the valve member 14. The expandable member 42 is, therefore, able to be positioned about the restraining member 28 and within the valve member 14.

The expandable member 42 includes a top half 44 and a bottom half 46. The top half 44 of the expandable member 42 has a solid cylindrical shape which will not deform when the expandable member 42 is utilized in the manner contemplated by the present invention. The bottom half 46 of the expandable member is, however, designed to deformed. The bottom half is also cylindrically shaped, but includes cut out portions 48 about its periphery. The cut out portions 48 form a series of arms 50. Each arm includes a proximal end 52 connected to the top half of the expandable member 28 and a distal end 54 connected to a ring 56 positioned at the lowest portion of the bottom half 46 of the expandable member 42. Each arm 50 is shaped to bow outwardly at a central portion 58 thereof. The bow permits the arms 50 to extend outwardly when the expandable member 42 is positioned between the valve member 14 and the restraining member 28, and the valve member 14 and the restraining member 28 are drawn toward each other.

Figure 3:
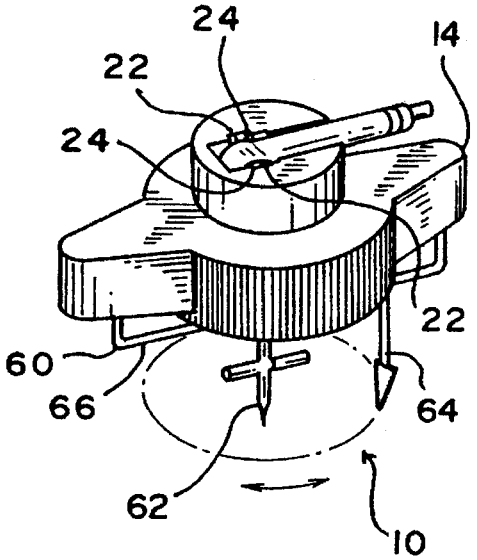
FIG. 3 is a perspective view of the valve member with the cutting implement secured thereto.

In use, a cutting implement 60 is first positioned within the valve member 14 as shown in FIG. 3. The cutting implement includes a central cutting 62 point and a blade 64 secured to the central cutting point 62 for cutting an opening when the cutting implement 60 is rotated. The central cutting point 62 and the blade 64 are connected by a support structure 66 designed to fit within the valve member 14, such that the cutting point 62 and the blade 64 are supported when the valve member 14 is rotated to cut a hole 67 within the wall 68 of a paint can 12, or other container. The support structure 66 includes projections 70 which fit within openings 72 in the valve member 14 to properly secure the cutting implement 60 to the valve member 14. Once the cutting implement 60 is properly positioned within the valve member 14, the cutting implement 60 is forced into the wall 68 of a paint can 12 and rotated to cut an appropriate sized hole 67 in the wall 68 of the paint can 12. The handles 26 on the valve member 14 enhance the users ability to grip the valve member 14 and rotate the cutting implement.

Once a hole 67 is cut in the wall 68 of the paint can, the cutting implement 60 is removed from the valve member 14. The expandable member 42 is then positioned about the restraining member 28 and within the valve member 14. The top portion 44 of the expandable member 42 is supported by the internal surface of the valve member 14, while the ring 56 at the bottom portion 46 of the expandable member 42 is supported by the circumferential ledge 40 at the distal end 32 of the restraining member 28. The ring 56 at the bottom portion 46 of the expandable member 42 is further held within a circumferential groove 74 positioned about the distal end 32 of the restraining member 28.

After the expandable member 42 is positioned between the valve member 14 and the restraining member 28, the threading on the valve member 14 and the restraining member 28 are slightly engaged to hold the closure assembly 10 together. The restraining member 28 and the expandable member 42 are then passed through the hole 67 previously formed in the wall 68 of the paint can 12. The valve member 14 is then seated on the outer surface 80 of the wall 68 of the paint can 12 and the valve member 14 is rotated. Rotation of the valve member 14 causes the threading on the valve member 14 and the restraining member 28 to draw the two parts toward each other. Rotation of the valve member 14 relative to the restraining member 28 is permitted because the expandable member 42 and the restraining member 28 are snuggly held within the hole 67. As the valve member 14 and the restraining member 28 are drawn toward each other, the bowed central portions 58 of the arms 50 expand outwardly. Rotation of the valve member 14 continues until the restraining member 28 is drawn upwardly to bring the arms 50 into contact with the inner surface 82 of the wall 68 of the paint can 12.

At this point, the closure 10 is securely held on the wall 68 of the paint can 12 in a manner creating a seal about the previously formed hole 67. The valve member 14 can then be opened to permit dispensing of the paint from within the can. It may be necessary to create a small opening in the paint can to permit venting when paint is dispensed through the closure.

It should be apparent that the closure can be removed from the paint can for reuse by simply reversing the steps used to secure the closure to the paint can. If an individual desires to permanently secure the closure to a container, an adhesive sealant could be placed on the expandable member without departing from the spirit of the present invention.

With the exception of the cutting implement, which is preferably made from a suitable metal, all of the elements of the closure are preferably manufactured from plastic. However, other materials could be used without departing from the spirit of the present invention.

Figure 4:
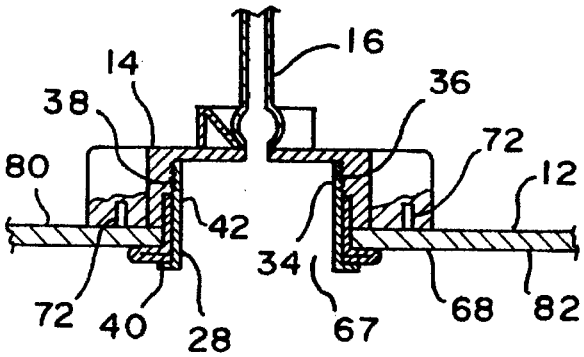
FIG. 4 is a cross sectional view of the closure secured to a paint can.

The closure can be used in conjunction with a paint dispensing assembly 82 as shown in FIG. 4. Briefly, the force of gravity is used to draw paint from the paint can for application to a desired object.

After the closure 10 is secured to the paint can 12 in the manner discussed above, a feed tube 84 is attached to the spout 16 and the paint can 12 may then be place on a support 86 with the closure 10, spout 16 and feed tube 84 extending downwardly. The support 86 includes first and second telescoping members 88, 90 releasably secured to each other. The first telescoping member 88 moves within the second telescoping member 90 and includes a series of holes 92 into which a pin 94 may be positioned to selectively hold the first telescoping member 88 and second telescoping member 90 relative to each other.

The first telescoping member 88 includes a first support arm 96 disgined to hold the handle 97 of a paint can 12 and a second support arm 98 designed to directly support the can 12 itself.

Applicators, for example, brushes 100 or rollers 102, may then be secured to the distal end 104 of the feed tube 84 by a releasable connector 106. Any currently known releasable connector could be used, without departing from the spirit of the present invention. Once the applicator is secured to the distal end 104 of the feed tube 84, the spout 16 may be opened and gravity permitted to force paint through the applicator so that it can be applied to a preselected object.

Figure 5:
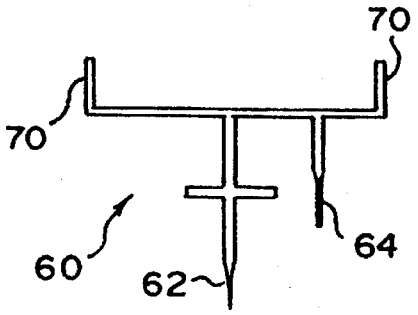
FIG. 5 is a plan view of the cutting implement.
Figure 6:
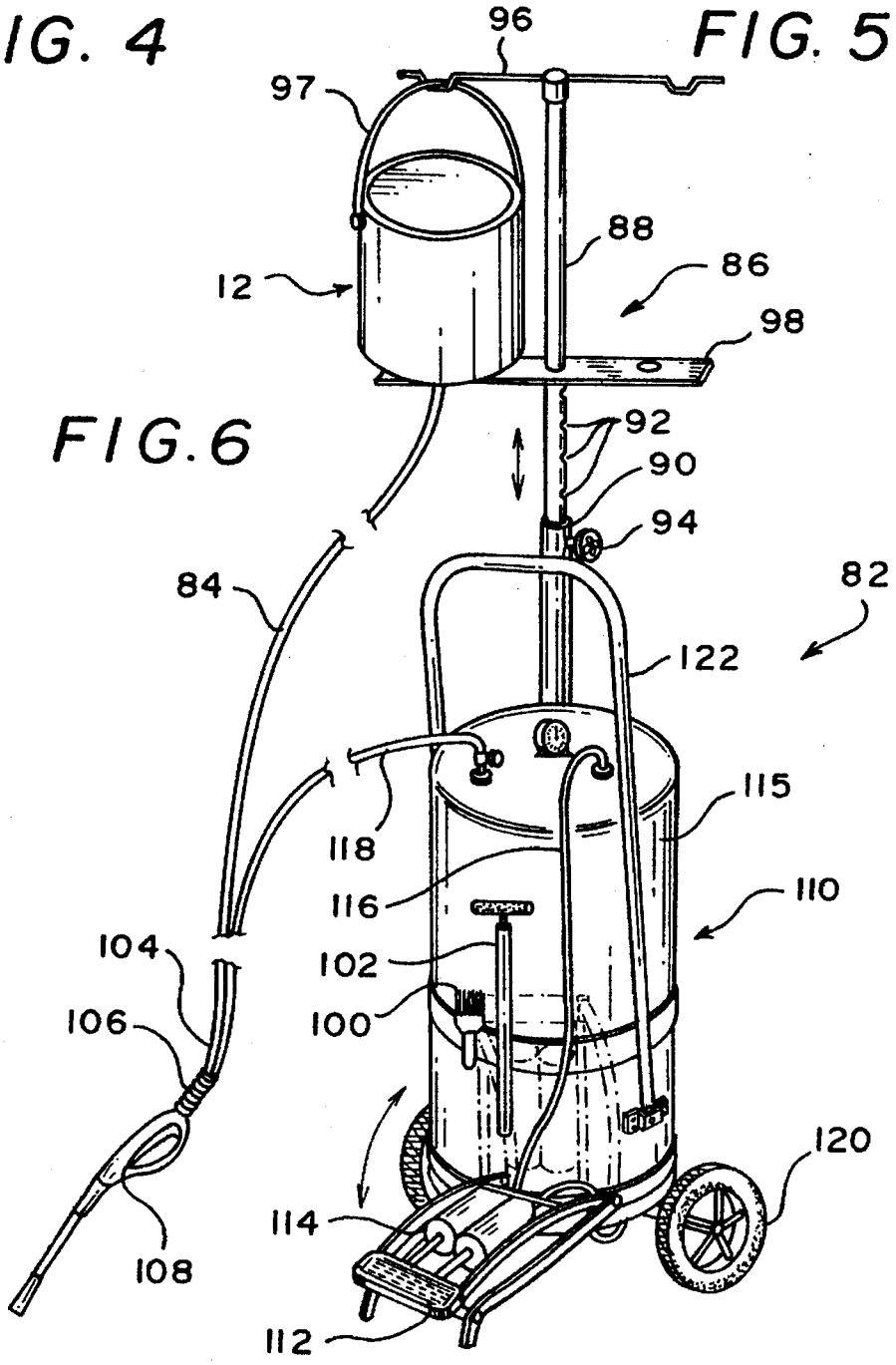
FIG. 6 is a perspective view of an assembly for applying liquids.

The embodiment shown in FIG. 5 includes a spray gun 108 releasable secured to the distal end 104 of the feed tube 84. Since gravity may not be sufficient to provide the force needed to pass the paint through the spray gun 108, a pressure source 110 may be provided. The pressure source 110 includes a foot pedal 112 secured to a pair of pneumatic cylinders 114. The pneumatic cylinders 114 are connected to a tank 115 by line 116. The tank 115 stores pressure and supplies pressure to the spray gun 108 via line 118. In use, an individual presses the foot pedal 112 causing pressure to build up within the tank 115. The pressure is then transferred to the spray gun 108, where it aids gravity in forcing the paint from the spray gun 108 with the necessary pressure. The pressure source 110 also includes wheels 120 and a handle 122 to facilitate the simple movement of the pressure source 110 from one location to another.

While the preferred embodiment has been shown and described, it will be understood that there is no intent to limit the invention by such disclosure, but rather, is intended to cover all modifications and alternate constructions falling within the spirit and scope of the invention as defined in the appended claims.

I claim:

1. A selectively attachable closure for a container, comprising:

a valve member connected to a restraining member by means for causing the restraining member to be drawn toward the valve member;

a central expandable member positioned between the valve member and the restraining member, whereby the central expandable member is caused to outwardly expand when the restraining member is drawn toward the valve member, the central expandable member having a hollow body positioned about the restraining member so that the central expandable member is supported by the restraining member;

wherein the restraining member and the central expandable member are passed within a hole formed in a container while the valve member is seated on a periphery of the hole to support the closure, and the restraining member is drawn toward the valve member causing the central expandable member to outwardly expand and secure the closure within the hole.

2. The closure according to claim 1, wherein the closure further includes means for creating an opening in the container.

3. The closure according to claim 2, wherein the means for creating an opening includes a cutting implement positionable within the valve member.

4. The closure according to claim 3, wherein the cutting implement includes a central cutting point and a blade secured to the central cutting point for cutting an opening when the cutting implement is rotated.

5. The closure according to claim 1, wherein the valve member includes a spout that may be rotated between an open position and a closed position.

6. The closure according to claim 1, wherein the means for causing the restraining member to be drawn toward the valve member includes cooperating threading on the restraining member and the valve member.

7. The closure according to claim 1, wherein the restraining member is cylindrical and includes an outward extending ledge at a distal end of the restraining member for supporting the central expandable member.

8. The closure according to claim 7, wherein the central expandable member is cylindrical, the central expandable member is shaped to fit about the restraining member and is supported by the ledge.

9. A method for dispensing liquids from a container without exposing the liquids to the environment before they are actually dispensed for use, comprising the following steps:

cutting an opening within the wall of a sealed container;

positioning a closure within the opening of the container to seal the opening, the closure comprising:

a valve member connected to a restraining member by means for causing the restraining member to be drawn toward the valve member;

a central expandable member positioned between the valve member and the restraining member, whereby the central expandable member is caused to outwardly expand when the restraining member is drawn toward the valve member, the central expandable member having a hollow body positioned about the restraining member so that the central expandable member is supported by the restraining member;

wherein the restraining member and the central expandable member are passed within a hole formed in a container while the valve member is seated on a periphery of the hole to support the closure, and the restraining member is drawn toward the valve member causing the central expandable member to outwardly expand and secure the closure within the hole;

elevating the container; and permitting the liquid to flow from the container and through the closure to an applicator for applying the liquid to a predetermined object.

10. The method according to claim 9, wherein the applicator is roller designed for applying liquids.

11. The method according to claim 9, wherein the liquid is paint.

12. The method according to claim 9, wherein the applicator is a brush designed for applying liquids.

13. The method according to claim 9, wherein the applicator is a spray gun.

14. The method according to claim 13, further including the step of applying pressurized air to the liquid to force it through the spray gun with sufficient force to apply the liquid.

15. The method according to claim 9, further including the step of applying pressurized air to the liquid to force it through the spray gun with sufficient force to apply the liquid.

16. An assembly for dispensing liquids from a sealed container without exposing the liquids to the environment until the liquids are applied to a predetermined object, comprising:

a selectively attachable closure for attachment to an opening formed in the sealed container, the closure comprising:

a valve member connected to a restraining member by means for causing the restraining member to be drawn toward the valve member;

a central expandable member positioned between the valve member and the restraining member, whereby the central expandable member is caused to outwardly expand when the restraining member is drawn toward the valve member, the central expandable member having a hollow body positioned about the restraining member so that the central expandable member is supported by the restraining member;

wherein the restraining member and the central expandable member are passed within a hole formed in a container while the valve member is seated on a periphery of the hole to support the closure, and the restraining member is drawn toward the valve member causing the central expandable member to outwardly expand and secure the closure within the hole;

a stand for supporting the container at an elevated position: and an applicator adapted for attachment to the valve member of the closure to permit a flow of the liquid from the container to the applicator permitting application of the liquid to a predetermined object.

17. The apparatus according to claim 16, wherein the applicator is roller designed for applying liquids.

18. The apparatus according to claim 16, wherein the liquid is paint.

19. The apparatus according to claim 16, wherein the applicator is a brush designed for applying liquids.

20. The apparatus according to claim 16, wherein the applicator is a spray gun.

21. The apparatus according to claim 20, further including the means for applying pressurized air to the liquid to force it through the spray gun with sufficient force to apply the liquid.

22. The apparatus according to claim 16, further including means for applying pressurized air to the liquid to force it through the spray gun with sufficient force to apply the liquid.

* * * * *